US006101744A

United States Patent [19]

Gallon

[11] Patent Number: 6,101,744

[45] Date of Patent: Aug. 15, 2000

[54] SKI BOOT

[75] Inventor: Denis Gallon, Feltre, Italy

[73] Assignee: Lange International S.A., Fribourg, Switzerland

[21] Appl. No.: 09/017,086

[22] Filed: Feb. 2, 1998

[30] Foreign Application Priority Data

Feb. 7, 1997 [IT] Italy ..... MI970079 U

[51] Int. Cl.[7] ..... A43B 5/04

[52] U.S. Cl. ..... 36/117.1; 36/50.5; 36/118.2

[58] Field of Search ..... 36/117.1, 118.2, 36/119.1, 115, 50.5

[56] References Cited

U.S. PATENT DOCUMENTS

| | | | |
|---|---|---|---|
| 3,849,914 | 11/1974 | Bertele | 36/50.5 |
| 4,654,985 | 4/1987 | Chalmers | 36/115 |
| 5,353,527 | 10/1994 | Hilgarth | 36/50.5 |
| 5,410,822 | 5/1995 | Vaccari | 36/117.1 |
| 5,632,105 | 5/1997 | Bonaventure | 36/117.1 |
| 5,718,067 | 2/1998 | Ostinet et al. | 36/117.1 |
| 5,765,299 | 6/1998 | Hayashi et al. | 36/117.1 |

FOREIGN PATENT DOCUMENTS

| | | |
|---|---|---|
| 699399A1 | 3/1996 | European Pat. Off. . |
| 749703A1 | 12/1996 | European Pat. Off. . |

*Primary Examiner*—Paul T. Sewell
*Assistant Examiner*—J. Mohandesi
*Attorney, Agent, or Firm*—Bugnion S.A.; John Moetteli

[57] ABSTRACT

A ski boot consisting essentially of a comfort liner (8), a lower shell (1) and a cuff (2) articulated to the lower shell. The cuff is provided with a strap (62) in its upper part and a lower-leg band (61) made of a material which is more rigid than the material of the cuff, these being rigidly connected to one another on the side of the boot corresponding to the inside of the foot.

2 Claims, 1 Drawing Sheet

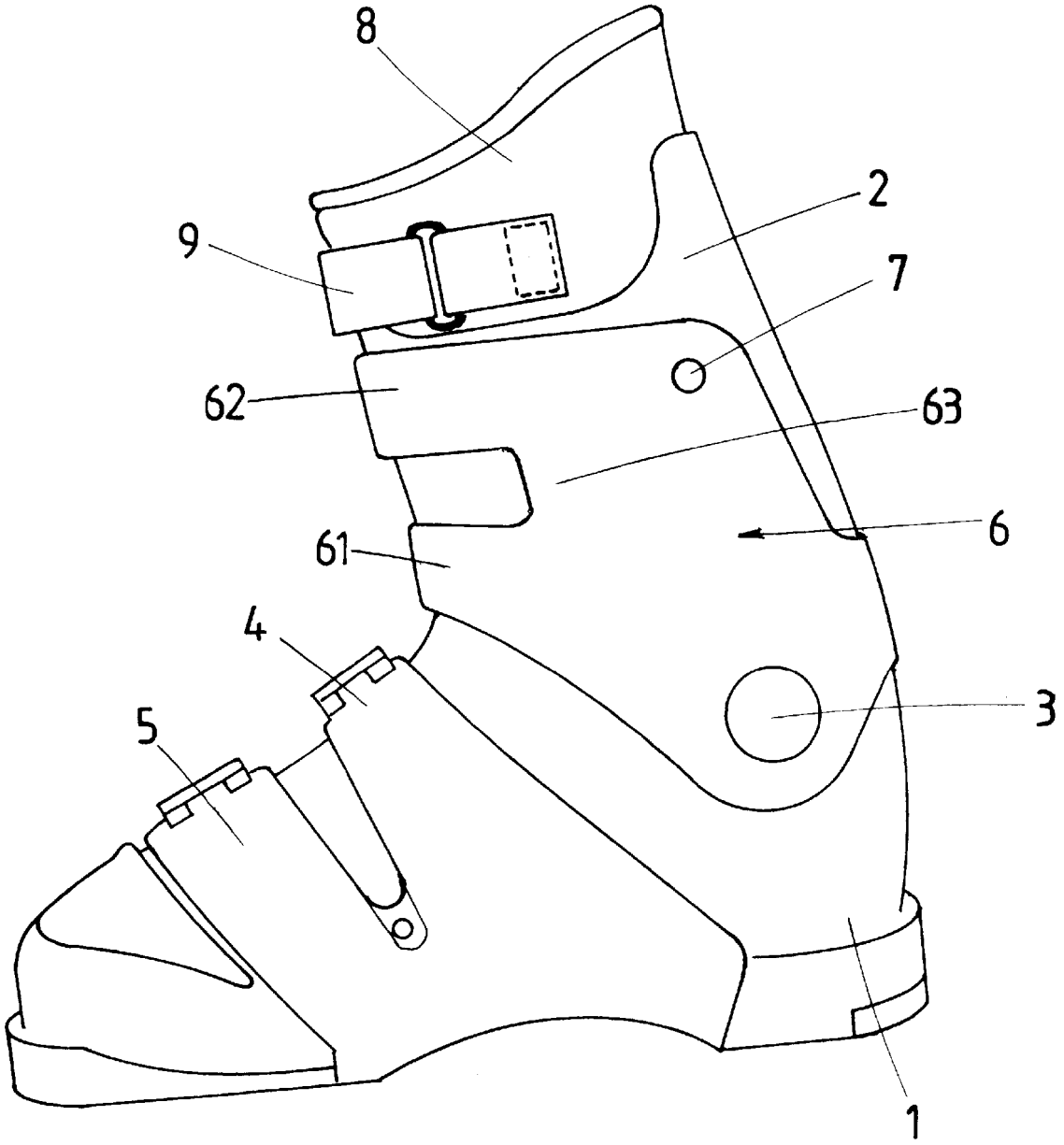
8
2
9
7
62
63
6
61
4
3
5
1

SKI BOOT

FIELD OF THE INVENTION

The invention relates to a ski boot consisting essentially of a comfort liner, a shell which constitutes the sole and the upper of the boot, an ankle cuff which is rotatably joined to the shell in the malleolar region and is provided with a strap for closure and tightening in its upper part, and a lower-leg band which is rotatably joined to the shell with the cuff and encloses the cuff above its articulation to the shell and is provided with a buckle for closure and tightening, the strap and the band being made of a material which is more rigid than the material constituting the cuff.

PRIOR ART

A boot of this type is known from European Patent Application No. 0 699 399, the additional band having the effect of improving the support of the lower leg without it being necessary, for this purpose, to increase the rigidity of the cuff.

SUMMARY OF THE INVENTION

The object of the present invention is to further improve the skiability of a boot of this type.

To this end, the boot according to the invention is one wherein the strap and the band are rigidly connected to one another on the side of the boot corresponding to the inside of the foot.

During a turn, the edge is set by bearing on the inside of the boot. The improvement according to the invention makes it possible to set the edges more aggressively, and consequently to ski more quickly and more securely, in particular on hard snow and ice.

The strap and the band are preferably manufactured together in one piece.

The width of the connection between the strap and the band may vary, but the connection preferably extends in a zone lying toward the front of the cuff.

BRIEF DESCRIPTION OF THE DRAWING

The appended drawing represents an illustrative embodiment of the boot according to the invention.

DESCRIPTION OF THE PREFERRED EMBODIMENT

The boot which is represented is intended for the right foot. It has a lower shell 1 constituting the sole and the upper of the boot, and a cuff 2 which is intended to enclose the ankle and is rotatably joined to the lower shell 1 at a point 3 in the malleolar region. The lower shell 1 has a variable volume and is provided with two tightening buckles 4 and 5. The cuff 2 is provided with an attached part 6 rotatably joined to the cuff 2 about the joint 3. This attached part 6 constitutes, on the one hand, a lower-leg band 61 which encloses the cuff above its joint 3 and is provided with a closure and tightening buckle lying on the outside (hidden in the drawing of the boot) and, on the other hand, a tightening strap 62 which lies in the upper part of the cuff 2 and is also provided with a closure and tightening buckle lying on the outside of the boot. The part 6 is further fixed to the cuff 2 at a point 7 level with the strap 62, which does not extend around the rear of the cuff.

The strap 62 and the band 61 are preferably connected by an integral connection (63).

The connection 63 between the band and the strap extends from the inside of the boot to a zone lying toward the front of the cuff, where force is to be transmitted. That end of the strap 7 which cannot be seen is connected by its buckle to the outside of the cuff 2.

The band 61 and the strap 62 are more rigid, than the cuff 2. The cuff is, for example, made of polyurethane with a hardness of 54 Shore D, while the band 61 and the strap 62 are made of polyurethane with a hardness of 60 Shore D.

The boot which is represented further comprises a comfort liner 8 provided with a tibial support strap 9.

The band and the strap could consist of two parts integrally assembled together.

I claim:

1. A ski boot consisting essentially of a comfort liner (8), a lower shell (1) which constitutes the sole and the upper of the boot, an ankle cuff (2) which a joint (3) rotatably joins to the lower shell in the malleolar region (3) and is provided with a strap (62) for closure and tightening in its upper part, and a lower-leg band (61) which is rotatably joined to the cuff and encloses the cuff (2) above the joint (3) to the lower shell and is provided with a buckle for closure and tightening, the strap and the band (61) are integrally and rigidly connected to one another on the side of the boot corresponding to the inside of the foot.

2. The boot as claimed in claim 1, wherein the connection (63) of the strap to the band extends from the inside of the foot to a zone lying toward the front of the cuff.

* * * * *